United States Patent [19]

von Camber et al.

[11] 4,005,537

[45] Feb. 1, 1977

[54] FOLD-A-BOARD

[76] Inventors: Peter A. von Camber; George Spector, both of 3615 Woolworth Bldg., 233 Broadway, New York, N.Y. 10007

[22] Filed: Mar. 11, 1975

[21] Appl. No.: 557,279

[52] U.S. Cl. ..... 40/125 H; 40/156

[51] Int. Cl.[2] ..... G09F 7/18

[58] Field of Search ..... 40/125 H, 125 N, 125 F, 40/125 R, 125 G, 156, 106.1, 129 R; 211/45–48; 248/465

[56] References Cited

UNITED STATES PATENTS

| | | | |
|---|---|---|---|
| 404,146 | 5/1889 | Ackerman | 248/465 |
| 1,469,212 | 10/1923 | De Pew | 40/125 H X |
| 2,844,897 | 7/1958 | Vance | 40/125 H |
| 2,864,191 | 12/1958 | Hagen | 40/125 H |
| 2,902,239 | 9/1959 | Janecka | 40/125 H X |
| 2,935,165 | 5/1960 | Elliott | 40/125 H X |

FOREIGN PATENTS OR APPLICATIONS

| | | | |
|---|---|---|---|
| 794,488 | 12/1935 | France | 40/140 |

*Primary Examiner*—John F. Pitrelli

[57] ABSTRACT

A framework that is readily foldable so that it can be stored in a minimum space and which is adaptable for various different uses such as a barricade or for displaying a sign; the device consisting of a saw-horse-like structure upon which there is surmounted a rectangular frame in which a sign panel can be fitted for display.

2 Claims, 6 Drawing Figures

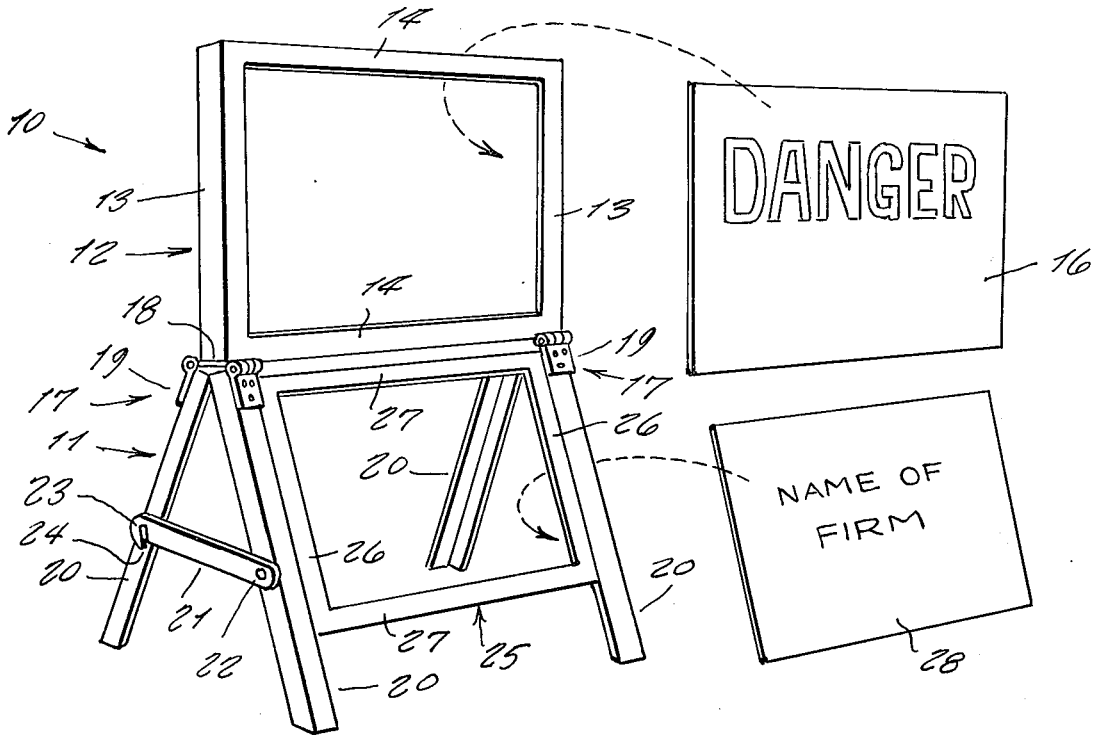
Fig. 1
Fig. 2
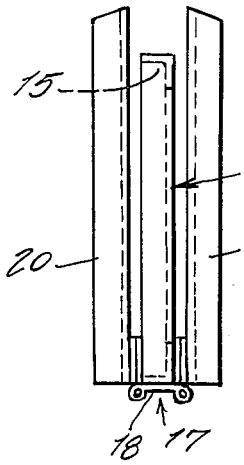
Fig. 4
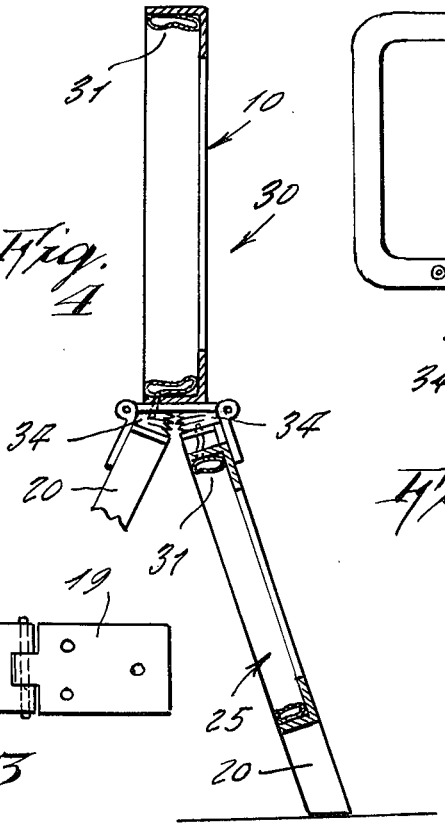
Fig. 6
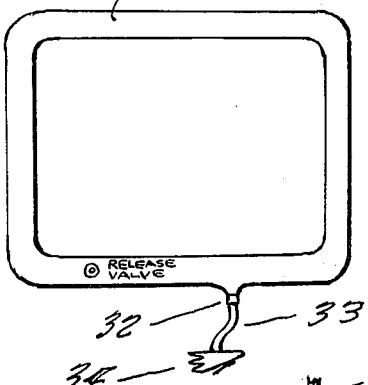
Fig. 5
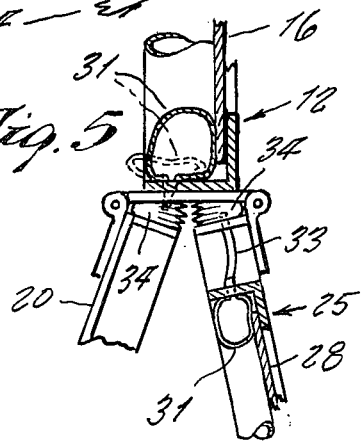
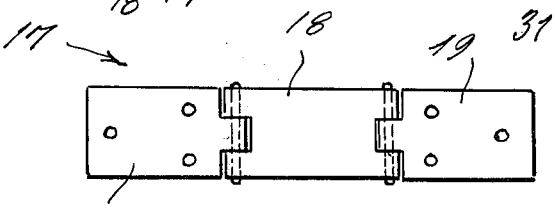
Fig. 3

FOLD-A-BOARD

This invention relates generally to supporting frames. More specifically it relates to sign board holders.

A principal object of the present invention is to provide a fold-a-board that is adaptable to hold up a sign panel, and which when not in use, is readily foldable so that it can be conveniently fitted into a transporting vehicle or into a minimum storage space.

Another object is to provide a fold-a-board which is designed so that its supporting legs also can display an additional lower sign.

Still another object is to provide a fold-a-board which alternately can be used either as a barricade, a saw-horse or other possible purposes.

Other objects are to provide a fold-a-board which is simple in design, inexpensive to manufacture, rugged in construction, easy to use and efficient in operation.

These and other objects will be readily evident upon a study of the following specification and the accompanying drawing wherein:

FIG. 1 is a perspective view of the invention.

FIG. 2 is a side edge view thereof shown folded up.

FIG. 3 is a view of one of the hinges.

FIG. 4 is a side cross section of a modified design of the invention in which air-inflatable tubes around the inner edges of the frames serve to retain a sign board from falling out of the frame; each tube being inflatable by an air bellows located under the hinge so that when a leg is pivoted back and forth a number of times, the tube is thus easily inflated.

FIG. 5 is an enlarged detail thereof showing the tubes in inflated condition, and showing that one leg operates the bellows to inflate the upper tube while the other leg operates the bellows to inflate the lower tube.

FIG. 6 is a side view of one of the tubes and bellow system.

Referring now to the drawing in detail, and more particularly to FIGS. 1 to 3 thereof at this time, the reference numeral 10 represents a fold-a-board according to the present invention wherein the same is comprised of a saw-horse-like framework 11 and a superstructure frame 12 mounted thereupon.

The frame 12 comprises a rectangular unitary structure made of angle iron opposite side members 13 and angle iron opposite upper and lower members 14 which at their corners are rigidly secured together by a weld, bolts or other equivalent means. The angle iron members thus form a pocket 15 around a rear side so that a sign panel 16 can be easily slipped therein in order to be displayed.

The lower, horizontal member 14 of the frame 12 serves as a backbone for the saw-horse-like framework 11. A three-leaf hinge 17 is mounted underneath each opposite end of the lower horizontal member 14 in a transverse direction, by welding said member to the center leaf 18 of the hinge, and each of the end leaves 19 of the hinge is bolted to an upper end of a leg 20 so that a pair of pivotable legs are provided at each end that can be pivoted between the position shown in FIG. 2 (wherein the legs are in a folded away position adjacent the frame 12), and a position shown in FIG. 1 (wherein the legs extend spreadingly downward in an A-shape configuration so to form an erected support for the frame 11). A brace 21 secured pivotally free at one end by a rivet or bolt 22 to one leg at one or both ends of the framework has a notch 23 in its opposite end for snapping around a projecting pin or rivet 24 on the other leg at the same end in order to rigidly hold the legs in the A-shaped position and prevent them from collapse.

A rectangular lower frame 25 is formed of similar angle iron members 26 and 27 secured together at their corners, and the frame is then rigidly secured between a leg at each end of the framework, the frame 25 serving to display a sign panel 28.

It is now evident that the fold-a-board can be quickly and easily set up or taken down, and which can support signs as wished.

In FIGS. 4 to 6, a modified design of fold-a-board 30 is shown to include the above-described fold-a-board 10 and additionally include a pair of inflatable rubber tubes 31 which are rectangular in shape so to fit within the pockets 15 of each frame 12 and 25. The tube is fitted with an air valve 32 such as is used in automobile tires, and which is connected by a flexible hose 33 to a bellows 34. Each of the bellows are fitted between an underside of lower horizontal angle iron member 14 and a different ones of the legs and secured there, so that in order to inflate either tube, a person needs only to move the leg back and forth. To release the air, the valve is manually opened, same as on automobile tires. Each of these tubes, secured by suitable adhesive in the pockets, serves to prevent the sign panel from falling out of the pocket after being placed therein, by forming a large bulge on a rear side thereof. To remove the sign, the tube is simply deflated, thus allowing room for the sign panel to be pushed out of the pocket.

Thus a modified design of the invention is provided.

While various changes may be made in the detail construction, it is understood that such changes will be within the spirit and scope of the present invention, as is defined by the appended claims.

What is claimed is:

1. In a fold-a-board, the combination of a foldable framework for standing on a ground surface and an upper frame secured symmetrically thereupon for holding a first sign panel, said framework including a lower frame for holding a second sign panel, said upper frame being pivotally secured to the framework along a central longitudinal axis including means for disposing the framework in a triangular shaped supporting position and pivotally folding said framework upwards on either side of the upper frame to assume a folded position, wherein said means comprises spaced pairs of hinges fixedly secured to said upper frame and pivotally secured to pairs of legs disposed below said upper frame, wherein said pairs of legs from a triangular base in said supporting position and can be pivoted upward to a folded position with the upper frame adjacent to said legs wherein one pair of legs include the second said frame mounted thereon, wherein the frames include rear pockets with inflatable means for retaining signs therein.

2. The combination as set forth in claim 1 wherein both said frames are rectangular in shape and are made of angle iron members so to form a pocket on a rear side in which said sign panels are placeable, said framework and means comprising threeleaf hinges secured to an underside of a lower horizontal angle iron member of said upper frame, a center leaf of said hinges being affixed near each end of said member underside, a leg attached to the end leaves of each said hinge, a brace on at least one leg hooking over a projecting pin on another leg so to retain said framework upright, and said lower frame being secured between a pair of said legs, wherein said inflatable means comprises an inflatable rubber tube is secured within each said pocket, an air valve and hose secured to each said tube being connected to an air bellows, each said air bellows being secured between said angle iron lower member underside and one of said legs.

* * * * *